US011999458B1

(12) United States Patent
Nickols et al.

(10) Patent No.: US 11,999,458 B1
(45) Date of Patent: Jun. 4, 2024

(54) TWO-PIECE HUB PROPELLER ASSEMBLY FOR MARINE DRIVES

(71) Applicant: Brunswick Corporation, Mettawa, IL (US)

(72) Inventors: Thomas F. Nickols, Fond du Lac, WI (US); Robert A. Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/864,630

(22) Filed: Jul. 14, 2022

(51) Int. Cl.
*B63H 1/20* (2006.01)
*B63H 23/34* (2006.01)
*B63H 1/14* (2006.01)

(52) U.S. Cl.
CPC ..... *B63H 1/20* (2013.01); *B63H 23/34* (2013.01); *B63H 1/14* (2013.01); *B63H 2023/342* (2013.01)

(58) Field of Classification Search
CPC ..... B63H 1/20; B63H 23/34; B63H 2023/342
See application file for complete search history.

(56) References Cited

U.S. PATENT DOCUMENTS 390,615 A * 10/1888 Nye ..... B63H 1/20 416/220 A
3,307,634 A * 3/1967 Bihlmire ..... B63H 1/20 416/214 R
4,642,057 A 2/1987 Frazzell et al.
5,201,679 A * 4/1993 Velte, Jr. ..... B63H 23/34 440/49
5,322,416 A 6/1994 Karls et al.
5,484,264 A 1/1996 Karls et al.
6,422,905 B2 7/2002 Samuelsson
6,478,543 B1 11/2002 Tuchscherer et al.
6,506,019 B2 1/2003 Lin et al.
7,223,073 B2 5/2007 Dean
7,357,686 B2 4/2008 Lin et al.
7,488,225 B2 2/2009 Lin
9,011,100 B2 4/2015 Ulgen
9,745,948 B1 8/2017 Koepsel
10,336,419 B1 7/2019 Guse et al.
10,875,615 B1 12/2020 Monroe et al.
11,588,363 B2 * 2/2023 Belzile ..... H02K 7/14
2022/0029488 A1 * 1/2022 Belzile ..... H02K 1/27

* cited by examiner

*Primary Examiner* — Eldon T Brockman
(74) *Attorney, Agent, or Firm* — Andrus Intellectual Property Law, LLP

(57) ABSTRACT

A propeller hub assembly for a marine drive having a propeller shaft is provided. The propeller hub assembly includes a first hub portion having a first main body and multiple propeller blades extending radially therefrom. The first main body is substantially cone-shaped and tapers inwardly from a first keyed end proximate the multiple propeller blades. The propeller hub assembly further includes a second hub portion having a second keyed end. The first hub portion is coupled to the second hub portion such that the first keyed end is mated to the second keyed end, and the first hub portion and the second hub portion are configured to engage the propeller shaft such that rotation of the propeller shaft causes rotation of the first hub portion and the second hub portion.

19 Claims, 6 Drawing Sheets

TWO-PIECE HUB PROPELLER ASSEMBLY FOR MARINE DRIVES

FIELD

The present disclosure relates to marine drives, and more particularly, to a two-piece hub propeller assembly that mounts to a propeller shaft of a marine drive.

BACKGROUND

The Background is provided to introduce a foundation and selection of concepts that are further described below in the Detailed Description. The Background is not intended to identify key or essential features of the claimed subject matter, nor is it intended to be used as an aid in limiting the scope of the claimed subject matter.

U.S. Pat. No. 4,642,057 discloses a marine propeller mounting arrangement that includes a sleeve member for mounting on a propeller shaft, a propeller having an inner hub which fits over the sleeve member and a cushion member fitting between the sleeve member and the propeller inner hub. The sleeve member includes radially extending projections registering with channels in the hub to positively drive the propeller, even in the event of failure of the cushion member. The propeller has an outer hub surrounding the inner hub to define an exhaust gas passageway through the propeller.

U.S. Pat. No. 5,322,416 discloses a marine drive in which a drive sleeve between the propeller shaft and the propeller hub absorbs shock after the propeller strikes an object by torsionally twisting between a forward end keyed to the propeller hub and a rearward end keyed to the propeller shaft. The drive sleeve is composed of a plastic material providing torsional twisting angular rotation at a first spring rate less than 100 lb. ft. per degree from 0° to 5° rotation, a second higher spring rate beyond 5° rotation, and supporting over 1,000 lb. ft. torque before failure.

U.S. Pat. No. 5,484,264 discloses a marine drive having a drive sleeve and a drive sleeve adapter between the propeller shaft and the propeller hub where the drive sleeve absorbs the shock of the propeller striking an object by torsionally twisting a forward end of the drive sleeve which is keyed to the propeller hub and where the adapter is keyed to the propeller shaft and the drive sleeve is keyed to the adapter. The combination provides both high load capability and shock protection.

U.S. Pat. No. 6,478,543 discloses a torque transmitting device for use in conjunction with a marine propulsion system provides an adapter that is attached in torque transmitting relation with a propulsor shaft for rotation about a central axis of rotation. The first insert portion is attached in torque transmitting relation with the adapter and a second insert portion is attached in torque transmitting relation with a hub of the propulsor hub which can be a marine propeller or an impeller. A third insert portion is connected between the first and second insert portions and is resilient in order to allow the first and second insert portions to rotate relative to each other about the central axis of rotation. The adapter is shaped to prevent compression of the first, second, and third insert portions in a direction parallel to the central axis of rotation. The relative shapes of the various components and the resilience of the third insert portion, which can be a plurality of titanium rods, provides significant compliance of the device under low torque magnitudes, but at higher torque magnitudes it provides a significantly decreased compliance to facilitate torque transfer between a propulsor shaft and the propulsor hub.

U.S. Pat. No. 10,336,419 discloses shock absorbing hub assemblies and methods of making the same for marine propulsion devices having a propeller shaft and propeller. The assembly has an adapter component having an inner bore that engages the propeller shaft's splined outer surface and having a body with axially extending engagement surfaces on one end and an elastic hub component on an opposite end. The elastic hub component has planar outer engagement surfaces that abut corresponding inner engagement surfaces on the propeller hub's inner bore. Upon initial propeller shaft rotation, the elastic hub component deflects and allows the adapter component to rotationally travel relative to the propeller hub while not rotating the propeller hub. Upon further rotation, the adapter component's axially extending engagement surfaces engage with the propeller hub to rotate the propeller hub. The elastic hub component has a spring rate small enough to reduce clutch rattle yet large enough to isolate transmission shift clunk.

U.S. Pat. No. 10,875,615 discloses a method of making a propeller includes forming the propeller to have blades coupled to an outer hub, the outer hub coupled to an inner hub via ribs, and the inner hub configured to be coupled to the marine vessel. The ribs each have first and second ends with a midpoint therebetween, an inner end and an outer end that define a width therebetween, and a leading surface and a trailing surface that define a thickness therebetween. The ribs are tapered such that the thickness is greater at the midpoint than at least at one of the first end and the second end, and scalloped such that the width is greater at the midpoint than at least at one of the first end and the second end. Each of the ribs is coupled to the outer hub in radial alignment with one of the blades.

Each of the above patents is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example of the present disclosure, a propeller hub assembly for a marine drive having a propeller shaft is provided. The propeller hub assembly includes a first hub portion having a first main body and multiple propeller blades extending radially therefrom. The first main body is substantially cone-shaped and tapers inwardly from a first keyed end proximate the multiple propeller blades. The propeller hub assembly further includes a second hub portion having a second keyed end. The first hub portion is coupled to the second hub portion such that the first keyed end is mated to the second keyed end, and the first hub portion and the second hub portion are configured to engage the propeller shaft such that rotation of the propeller shaft causes rotation of the first hub portion and the second hub portion.

According to another example of the present disclosure, a. marine drive includes a driving element that drives a propeller shaft and propeller hub into rotation. The propeller hub includes a first hub portion having a first main body and multiple propeller blades extending radially therefrom. The first main body has a first keyed end proximate the propeller blades. The propeller hub further includes a second hub portion having a second keyed end. The first hub portion is coupled to the second hub portion such that the first keyed end is mated to the second keyed end, and the first hub portion and the second hub portion are configured to engage the propeller shaft such that rotation of the propeller shaft causes rotation of the first hub portion and the second hub portion.

According to a further example of the present disclosure, a method of making a propeller hub assembly for a marine drive having a propeller shaft is provided. The method includes providing a first hub portion having a first main body and multiple propeller blades extending radially therefrom. The first main body has a first keyed end proximate the propeller blades. The method further includes providing a second hub portion having a second keyed end; and joining the first hub portion and the second hub portion to each other and to the propeller shaft such that rotation of the propeller shaft causes rotation of the first hub portion and the second hub portion.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clearness and understanding. No unnecessary limitations are to be inferred therefrom beyond the requirement of the prior art because such terms are used for descriptive purposes only and are intended to be broadly construed.

Propeller hubs for marine vessels are often fabricated using a die casting process. In order to facilitate removal of cast components from molds, designers must incorporate tapered features into the components. In some instances, the incorporation of such tapered features may result in a degradation of the performance of the die cast propeller hub. For example, an inward taper on a side of the propeller hub between the propeller blades and the gearcase (as opposed to an inward taper from the propeller blades to the rear of the drive) may induce drag around the area between the propeller blades and the gearcase, thereby reducing the hydrodynamic efficiency of the propeller assembly. Although the effects of incorporating such tapers into the part may be mitigated by designing the molds of the casting process to pull away from each of the propeller blades in a radial direction, rather than an axial direction (i.e., along a propeller shaft axis), such a modification to the casting process adds significant fabrication time and cost to the parts.

The present inventors have therefore recognized that a propeller hub comprising two individually cast parts that are subsequently joined to each other may avoid the disadvantages of the traditional fabrication process as detailed above. Fabrication of separate propeller hub components further permits the use of dissimilar materials for the components, resulting in additional cost and weight reductions for the propeller hub assembly, as explained in further detail below.

Figure 1:
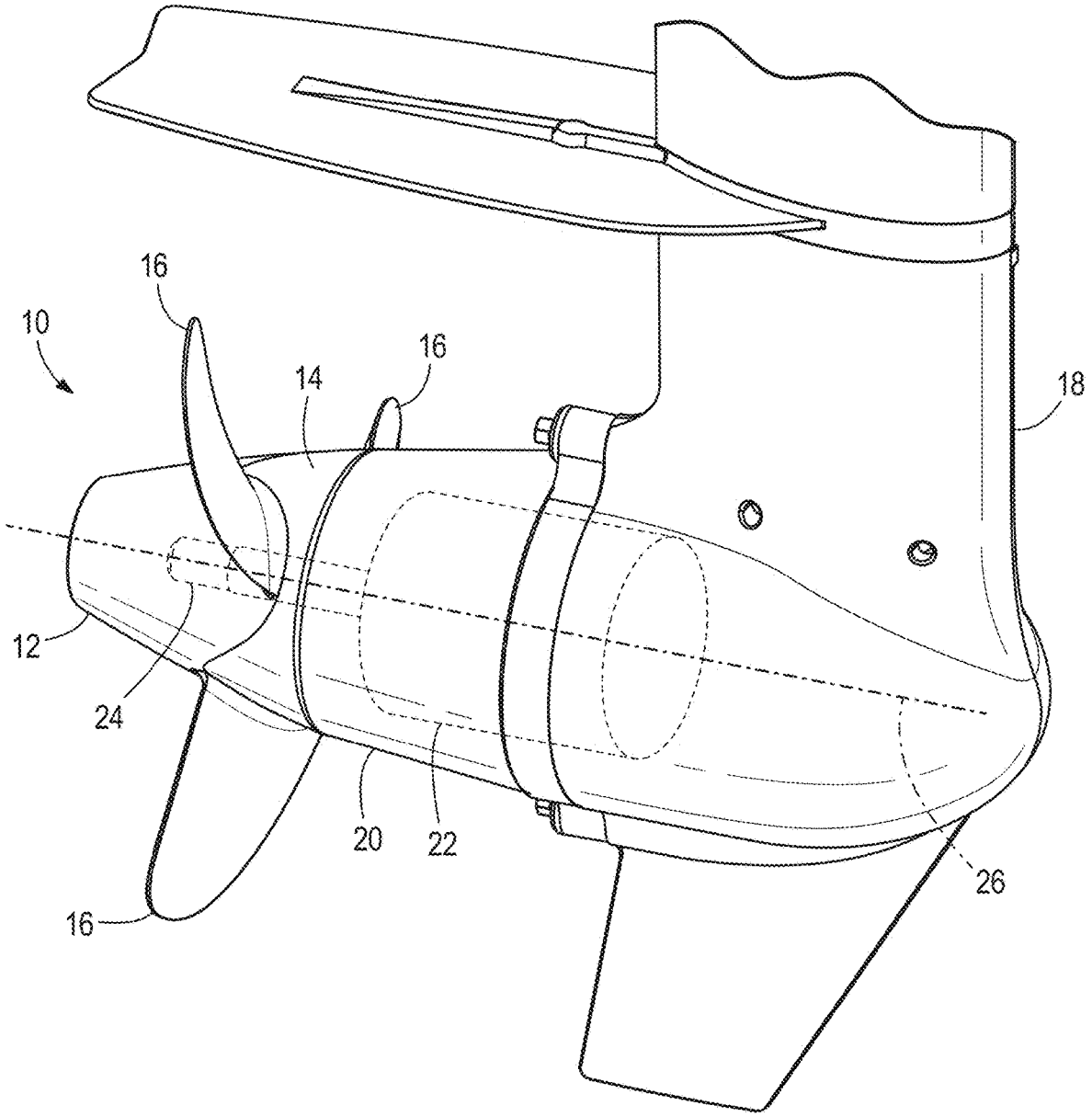
FIG. 1 is a perspective view of a two-piece hub propeller assembly as installed on an outboard motor.

FIG. 1 depicts a lower portion of a marine drive according to an exemplary embodiment of the present invention, which in the illustrated example is an outboard motor. The exemplary outboard motor includes a driving element (e.g., an internal combustion engine or electric motor) that causes rotation of a vertically extending driveshaft (not shown) into a first torpedo housing component 18. The lower end of the driveshaft is engaged via a propeller shaft bearing hub 22 located in the first torpedo housing component 18 and a second torpedo housing component 20 to a propeller shaft 24. The propeller shaft 24 extends laterally from the bearing hub 22 and is configured to rotate about shaft axis 26.

The propeller shaft 24 supports a two-piece hub propeller assembly 10 having a first hub portion 12 and a second hub portion 14 that are joined to each other, as will be described in further detail below. The propeller assembly 10 is configured to impart propulsive forces via blades 16 on the body of water in which the outboard motor is operating. Although FIG. 1 depicts an outboard motor, the concepts of the present disclosure are also applicable to other types of marine drives, including alternatively configured outboard motors, inboard motors, stern drives, and/or the like.

Figure 2:
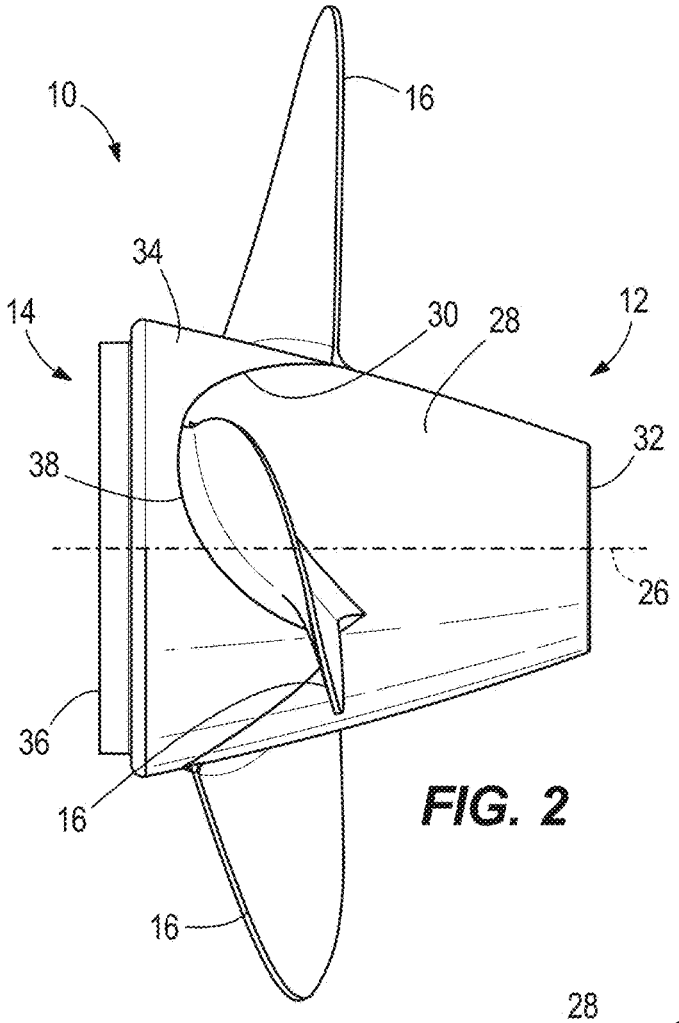
FIG. 2 is a side view of the two-piece hub propeller assembly of FIG. 1.
Figure 3:
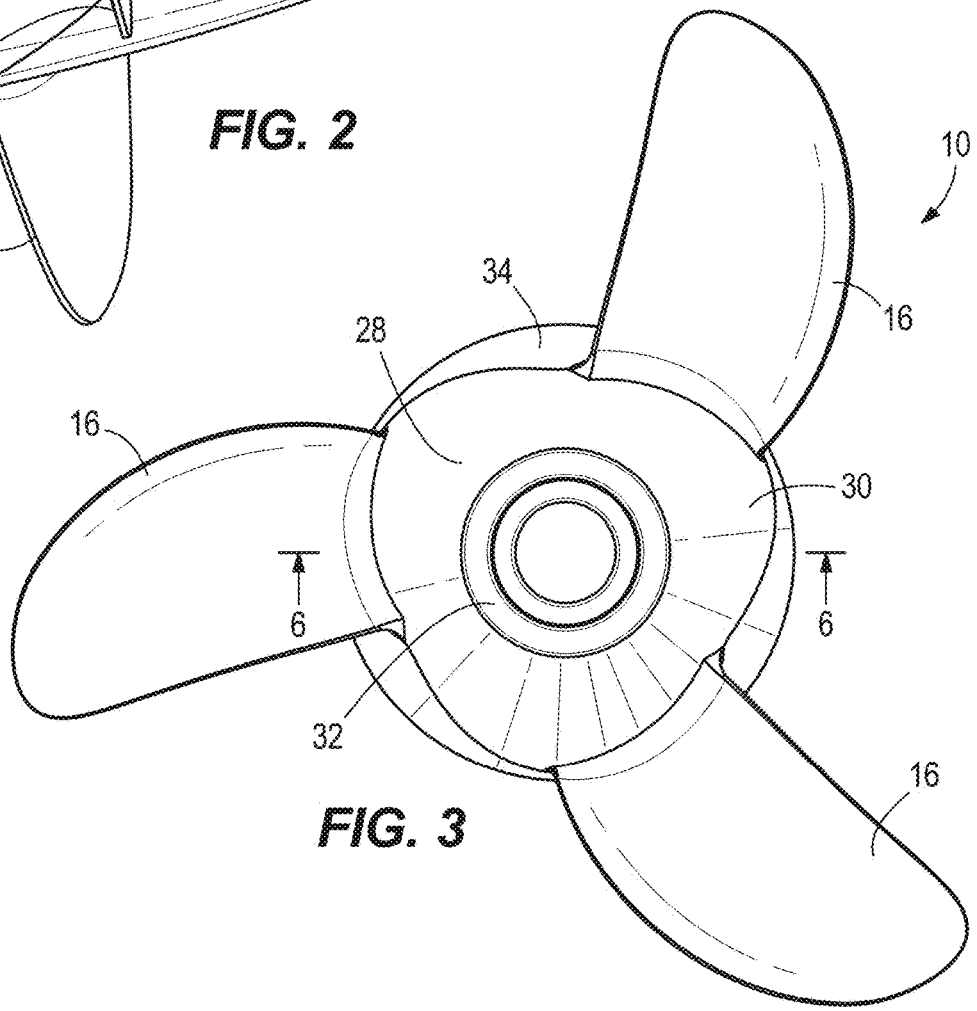
FIG. 3 is a rear view of the two-piece hub propeller assembly of FIG. 1.
Figure 4:
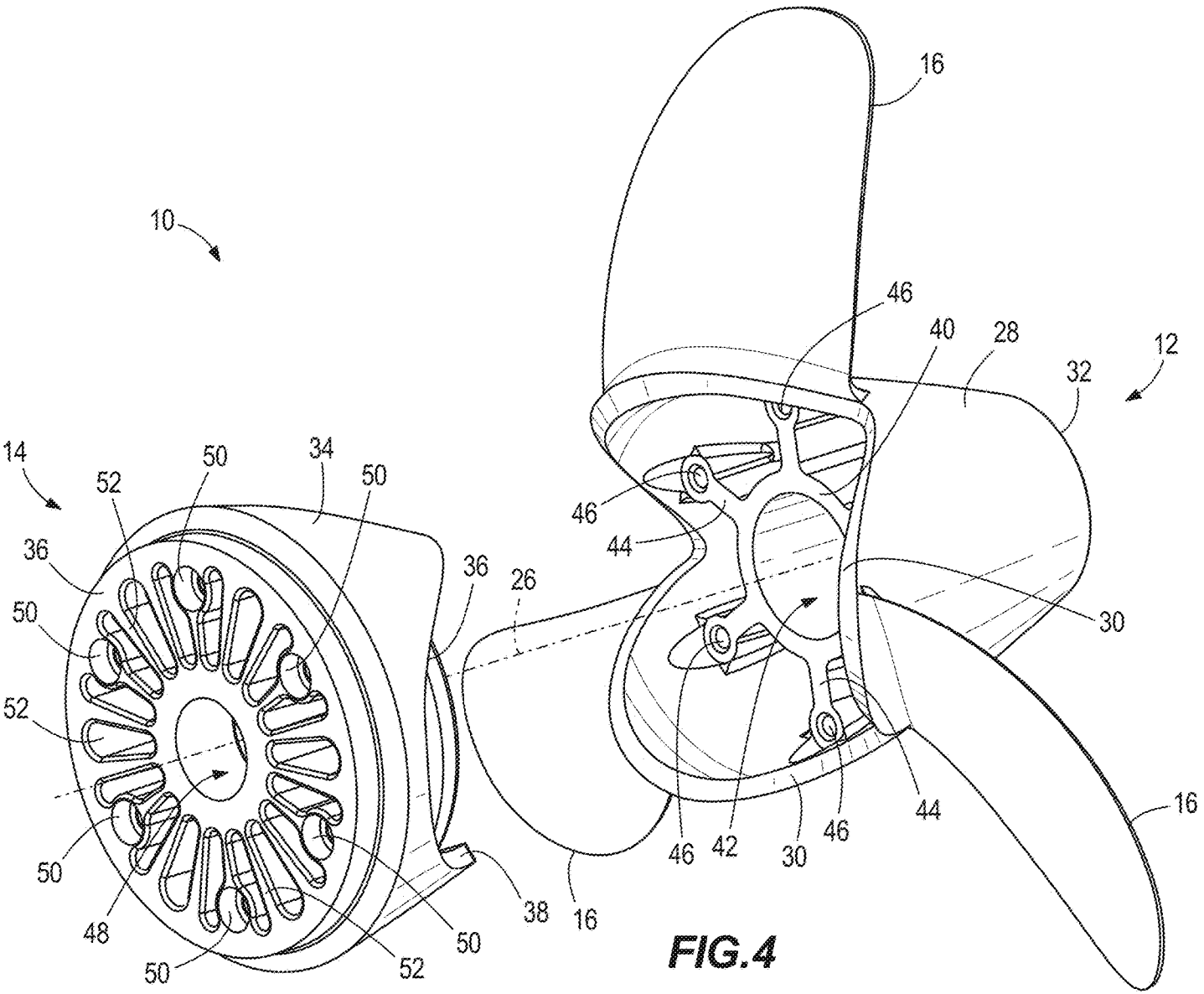
FIG. 4 is a perspective exploded view of the two-piece hub propeller assembly of FIG. 1.
Figure 5:
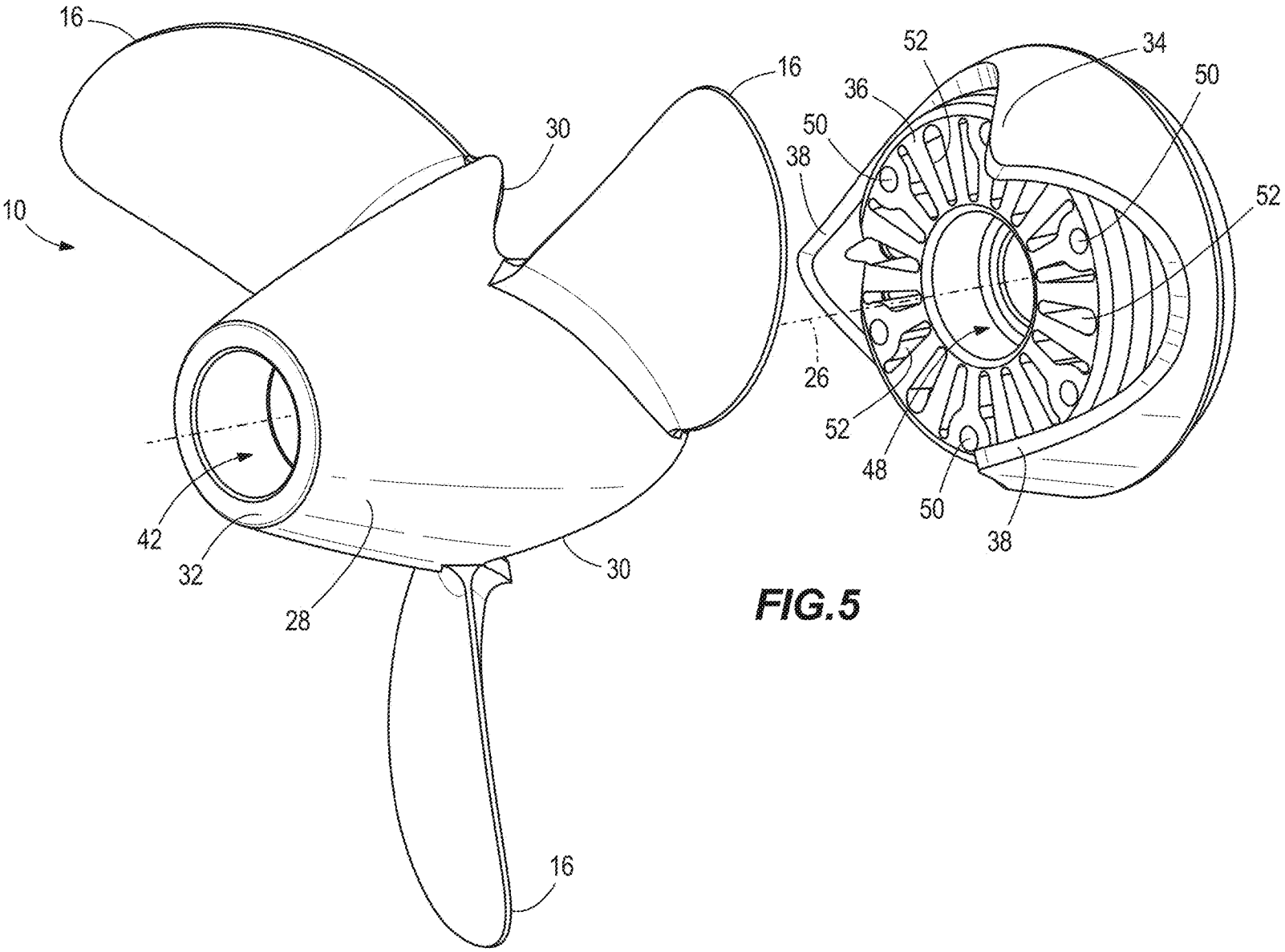
FIG. 5 is another perspective exploded view of the two-piece hub propeller assembly of FIG. 1.

Turning now to FIGS. 2-5, various views of the two-piece propeller hub assembly 10 are depicted. Specifically, FIGS. 2 and 3 respectively depict side and rear views of the assembly 10 in its assembled state in which the first hub portion 12 is joined to the second hub portion 14, while FIGS. 4 and 5 depict exploded views of the assembly 10.

The first hub portion 12 has a main hub body 28 from which multiple blades 16 extend in a radial direction. Although FIGS. 1-6 depict the first hub portion 12 as including three blades, there is no limitation as to the number of blades 16 and their shape. The main hub body 28 is shown to have a generally conical shape that tapers inwardly from a first parting line surface 30 that comprises the largest outer diameter of the first hub portion 12 to a terminating surface 32 that comprises the smallest outer diameter of the first hub portion 12. The second hub portion 14 has a main hub body 34 and is shown to extend from a mating surface of an inner body 36 to a second parting line surface 38. As will be described in further detail below, the parting line surfaces 30, 38 are formed along the parting lines where mold components are joined during the exemplary die casting process utilized to fabricate the two-piece propeller hub assembly 10. In an exemplary implementation, the parting line surface 30 of the first hub portion 12 is not flat but instead is contoured to match the curves of the propeller blades 16. The parting line surface 38 of the second hub portion 14 includes matching contours to the parting line surface 30 such that the parting line surfaces 30, 38 act as keying ends to aid in the successful mating of the first hub portion 12 to the second hub portion 14. In other implementations, the parting line surfaces 30, 38 could have a different key shape.

When the first hub portion 12 and the second hub portion 14 are coupled to each other, as is shown in FIGS. 1-3, the hub assembly 10 generally forms a continuous teardrop or torpedo shape with the gearcase housing components 18-20. The present inventors have recognized that such a shape is hydrodynamically advantageous, as drag induced by the gearcase and propeller is minimized. Reducing drag can decrease the fuel or power consumed by the internal combustion engine or electric motor that drives the propeller shaft, thereby increasing the range of the marine vessel and the intervals between refueling or recharging.

Referring now specifically to FIGS. 4 and 5, the interior region of the first hub portion 12 is visible and is shown to include an inner bore body 40 that surrounds a central bore 42. Multiple spokes 44 are shown to extend from the inner bore body 40 and terminate at the main hub body 28. The spokes 44 may be configured to absorb vibrations of propeller shaft 24 that are imparted to the inner bore body 40 and prevent them from being transmitted to the main hub body 28 and the propeller blades 16. Each of the spokes 44 is shown to include a mounting hole 46 formed near the hub body 28. In an exemplary implementation, the mounting holes 46 are threaded holes configured to receive threaded fasteners (see FIG. 6).

The second hub portion 14 is shown to include the main hub body 34 and the inner body 36. The inner body 36 includes a central bore 48 with multiple mounting holes 50 and spokes 52 arranged in a radial pattern around the central bore 48. The mounting holes 50 may be through holes configured to permit the passage of fasteners that are threadably coupled to the mounting holes 46 in the first hub portion 12. Although the first hub portion 12 and the second hub portion 14 are shown to include six mounting holes 46, 50, any number of mounting holes required to securely fasten the first hub portion 12 to the second hub portion 14 may be utilized. The spokes 52 may be configured to reduce the overall weight of the second hub portion 14 and, like the spokes 44 of the first hub portion 12, absorb vibrations of the propeller shaft 24 to prevent their transmission to the propeller blades 16. The number of spokes 52 is not particularly limited.

Figure 6:
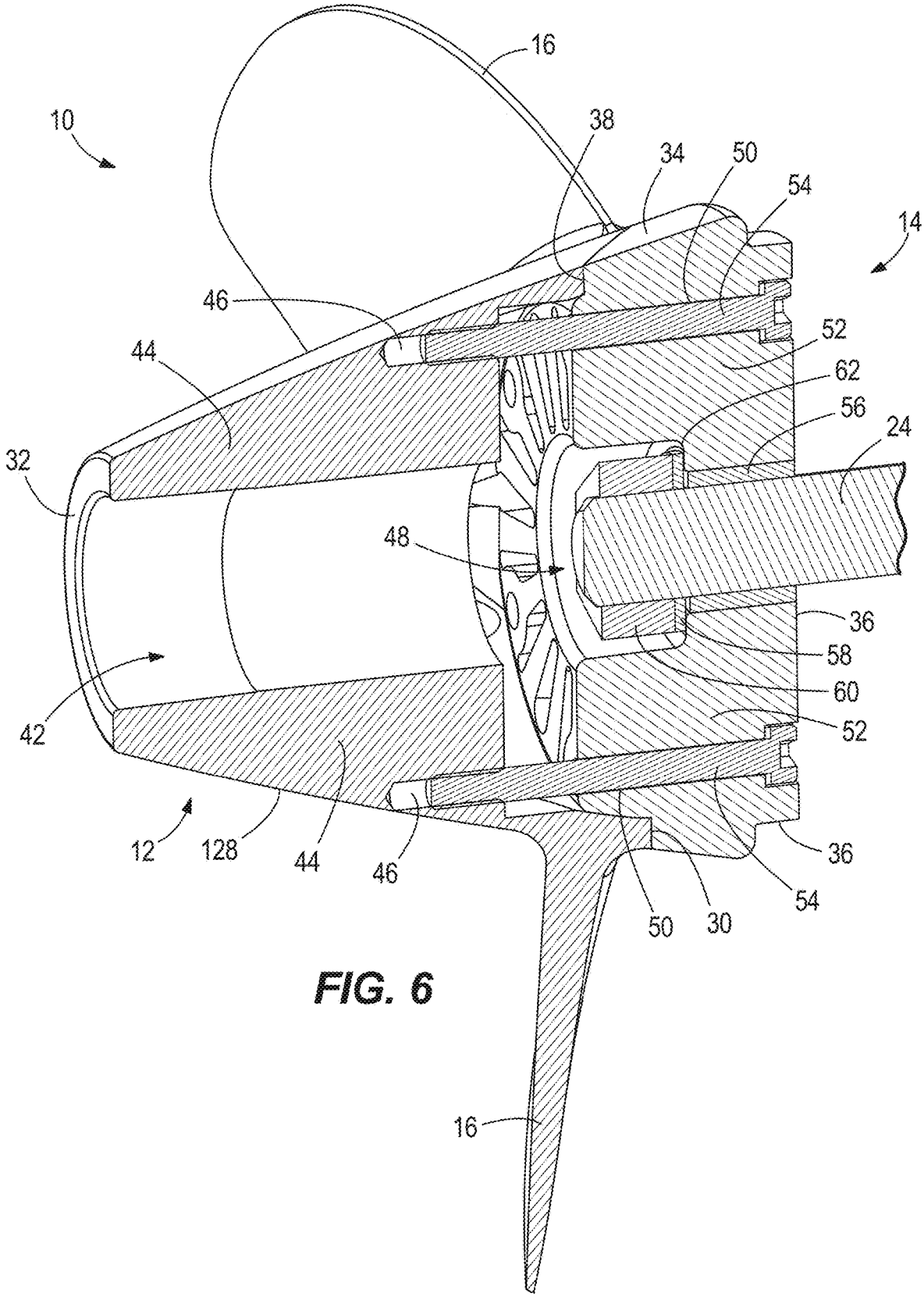
FIG. 6 is a side cross-sectional view of the two-piece hub propeller assembly taken along the line 6-6 of FIG. 3.

FIG. 6 depicts a side cross-sectional view of the propeller assembly 10 including an exemplary coupling arrangement of the first hub portion 12 to the second hub portion 14. In this exemplary arrangement, the propeller shaft 24 is shown to extend through the central opening 48 of the second hub portion 14. In an exemplary embodiment, a torque transmitting insert and compression limiter 56 may be located between the second hub portion 14 and the propeller shaft 24. The propeller shaft 24 is secured against fastening surface 62 of the second hub portion 14 using washer 58 and nut 60, as is conventional. Locating the compression limiter between 56 second hub portion 14 and the propeller shaft 24 ensures that the second hub portion 14 is not crushed when the nut 60 is tightened on the propeller shaft 24. Fasteners 54 are shown to extend through mounting holes 50 in the second hub portion 14 into mounting holes 46 in the first hub portion 12. In an exemplary embodiment, the fasteners 54 are threaded fasteners (e.g., bolts) and the mounting holes 46 are threaded holes, although other types of fasteners (e.g., pins) may be utilized to couple the first hub portion 12 and the second hub portion 14 and transfer rotational movement of the propeller shaft 24 to the two-piece hub propeller assembly 10.

The materials utilized in the casting process for the first hub portion 12 and the second hub portion 14 are not particularly limited. In various embodiments, each of the first hub portion 12 and the second hub portion 14 may be cast from an aluminum alloy (e.g., Mercalloy®), polymer (e.g., a glass-filled polymer such as Celstran® PBT-GF50-08 or Domonyl™ 1850R15H1U3 BK-7), or stainless steel (e.g., X7® alloy). In some embodiments, the first hub portion 12 and the second hub portion 14 may be casted from dissimilar materials having dissimilar properties (e.g., density values, compliance values, etc.). For example, the first hub portion 12 may be casted from an aluminum alloy (i.e., a heavier, less compliant, and more expensive material) and the second hub portion 14 may be casted from a polymer (i.e., a lighter, more compliant, and less expensive material). Such an arrangement of dissimilar materials may advantageously decrease the overall weight and/or cost of the propeller assembly 10.

Figure 9:
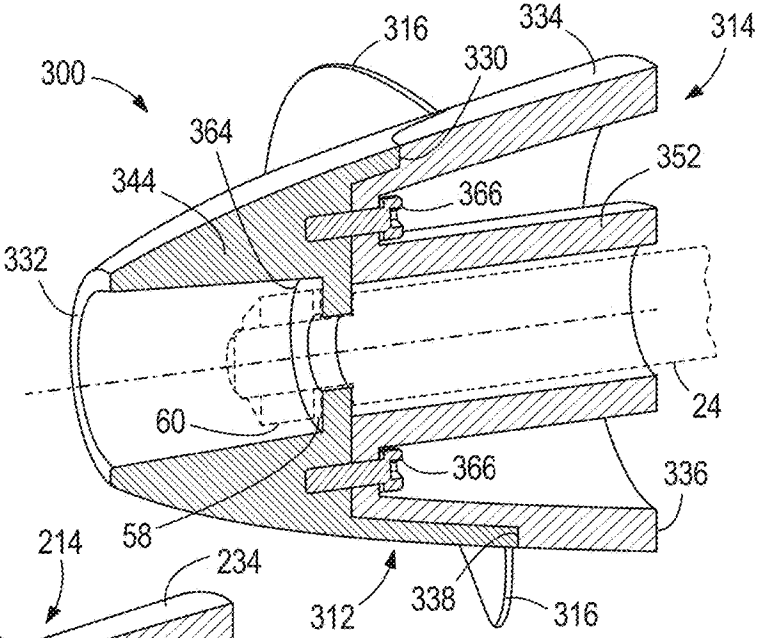
FIG. 9 is a side cross-sectional view of another embodiment of the two-piece hub propeller assembly depicting another bolted mating arrangement.
Figure 8:
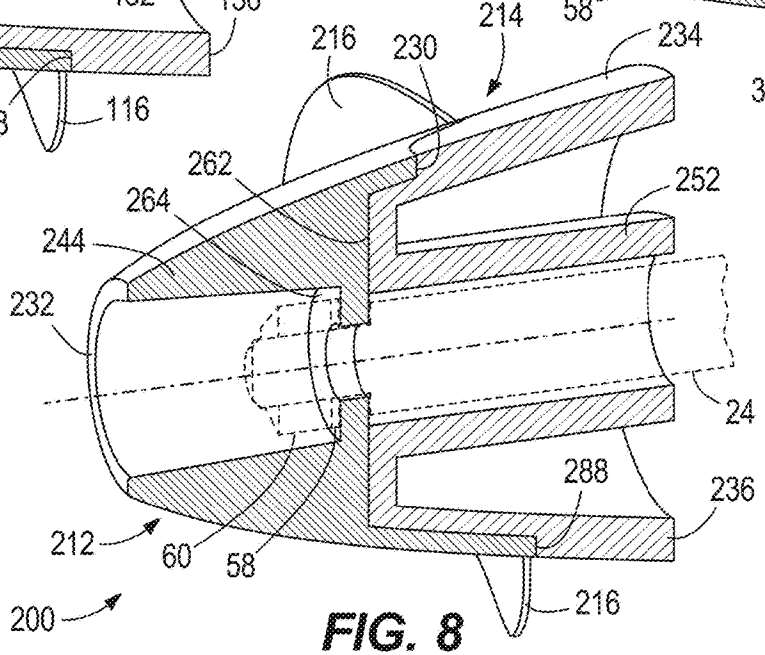
FIG. 8 is a side cross-sectional view of another embodiment of the two-piece hub propeller assembly depicting a sandwich bolted mating arrangement.
Figure 7:
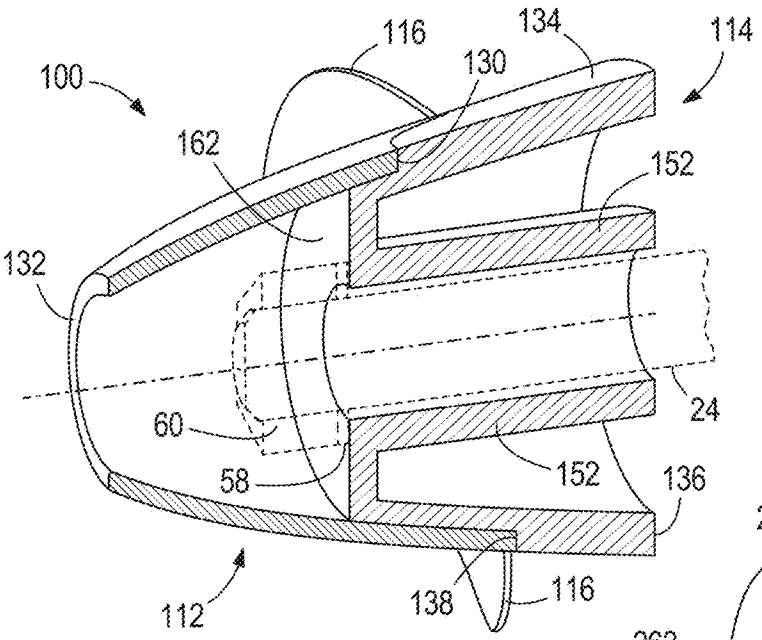
FIG. 7 is a side cross-sectional view of another embodiment of the two-piece hub propeller assembly depicting a bonded mating arrangement.

FIGS. 7-9 are side cross-sectional views that depict alternative embodiments of joining a two-piece hub propeller assembly. Many of the features of the propeller assemblies 100, 200, 300 respectively depicted in FIGS. 7-9 are identical or substantially similar to the features of the propeller assembly 10 depicted in FIGS. 1-6 (e.g., propeller blades 16 of assembly 10 are identical to the propeller blades 116 of assembly 100, etc.).

FIG. 7 depicts a two-piece hub propeller assembly 100 in which the first hub portion 112 and the second hub portion 114 are coupled to each other using a bonding agent (e.g., using 3M™ 08217 Clear Two-Part Epoxy) or welded joint (provided the first hub portion 112 and the second hub portion 114 are fabricated from similar materials) between the first parting line surface 130 and the second parting line surface 138. No other fasteners are required to couple the first hub portion 112 to the second hub portion 114, although in other embodiments as depicted in FIGS. 1-6, 8, and 9, a bonded or welded joint between the first hub portion and the second hub portion may be used in addition to threaded fasteners. In still further embodiments, complementary mechanical features (e.g., click together or snap fit features) on the first hub portion and the second hub portion may be additionally utilized to join the hub portions in conjunction with or in place of adhesives and/or threaded fasteners.

Still referring to FIG. 7, propeller shaft 24 is shown to extend through ribbed region 152 of the hub portion 114 and is secured against fastening surface 162 using a propeller washer 58 and propeller nut 60. Because the hub portions 112, 114 are secured to each other using a bonded or welded joint rather than fasteners, and because the propeller shaft 24 is secured against a fastening surface 162 of the second hub portion 114, an inner hub and spokes (e.g., inner hub 40 and spokes 44, see FIG. 4) may be omitted from the first hub portion 112, thereby reducing the overall weight of the propeller assembly 100.

FIG. 8 depicts a two-piece hub propeller assembly 200 in which the first hub portion 212 and the second hub portion 214 are bonded using a sandwich bolting arrangement. In this arrangement, the propeller shaft 24 extends through both the first hub portion 212 and the second hub portion 214 (as opposed to the arrangement depicted in FIG. 6, in which the propeller shaft 24 only extends through the second hub portion 14). The clamping force of the propeller nut 60 against fastening surface 264 of the first hub portion 212 holds the first hub portion 212 and the second hub portion 214 in a mated configuration such that the first hub portion 212 carries all of the driving loads imparted by the propeller shaft 24, and the second hub portion 214 carries only hydrodynamic loads. No further fasteners or fastening agents are required, although as described above, the first hub portion 212 and the second hub portion 214 may include mechanical features that permit click together assembly of the first hub portion 212 and the second hub portion 214. FIG. 9 depicts a modified version of the sandwich bolted arrangement of FIG. 8, in which the propeller shaft 24 extends though both the first hub portion 312 and the second hub portion 314, and the propeller nut 60 is secured against fastening surface 364 of the first hub portion 312. In addition to the clamping force provided by the propeller nut 60, threaded fasteners 366 are shown to secure the first hub portion 312 to the second hub portion 314. Such an arrangement may be utilized in environments in which a higher clamping force or more secure clamping arrangement is required.

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A propeller hub assembly for a marine drive, the propeller hub assembly comprising:

a first hub portion having a first outer surface and a plurality of propeller blades extending radially therefrom, wherein the first outer surface tapers inwardly from a first keyed end proximate the plurality of propeller blades; and a second hub portion having a second outer surface, wherein the second outer surface tapers outwardly from a second keyed end and wherein the first keyed end is coupled to the second keyed end.

2. The propeller hub assembly of claim 1, wherein the first hub portion is fabricated from a first material and the second hub portion is fabricated from a second material, and wherein the first material is different from the second material.

3. The propeller hub assembly of claim 2, wherein the first material has a first compliance value and the second material has a second compliance value, and wherein the first compliance value is different from the second compliance value.

4. The propeller hub assembly of claim 3, wherein the first compliance value is lower than the second compliance value.

5. The propeller hub assembly of claim 2, wherein the first material has a first density value and the second material has a second density value, and wherein the first density value is different from than the second density value.

6. The propeller hub assembly of claim 5, wherein the first density value is higher than the second density value.

7. The propeller hub assembly of claim 1, wherein the first keyed end is coupled to the second keyed end using a bonding agent.

8. The propeller hub assembly of claim 1, wherein the first keyed end is coupled to the second keyed end using a welded joint.

9. The propeller hub assembly of claim 1, wherein the first keyed end is coupled to the second keyed end using a sandwich bolted joint in which a propeller shaft extends through the first hub portion and the second hub portion, and a nut coupled to the propeller shaft is secured against a fastening surface of the first hub portion.

10. The propeller hub assembly of claim 1, wherein the first keyed end is coupled to the second keyed end using a plurality of fasteners.

11. The propeller hub assembly of claim 1, wherein each of the first hub portion and the second hub portion is fabricated using a die casting process.

12. A marine drive comprising:

a driving element that drives a propeller shaft and propeller hub into rotation, the propeller hub comprising:

a first hub portion having a first outer surface and a plurality of propeller blades extending radially therefrom, wherein the first outer surface tapers inwardly from a first keyed end proximate the plurality of propeller blades; and a second hub portion having a second outer surface, wherein the second outer surface tapers outwardly from a second keyed end and wherein the first keyed end is coupled to the second keyed end.

13. The marine drive of claim 12, wherein the first hub portion is fabricated from a first material and the second hub portion is fabricated from a second material, and wherein the first material is different from the second material.

14. The marine drive of claim 12, wherein the first keyed end is coupled to the second keyed end using a bonding agent.

15. The marine drive of claim 12, wherein the first keyed end is coupled to the second keyed end using a welded joint.

16. The marine drive of claim 12, wherein the first keyed end is coupled to the second keyed end using a sandwich bolted joint in which the propeller shaft extends through the first hub portion and the second hub portion, and a nut coupled to the propeller shaft is secured against a fastening surface of the first hub portion.

17. The marine drive of claim 12, wherein the first keyed end is coupled to the second keyed end using a plurality of fasteners.

18. A method of making a propeller hub assembly for a marine drive, the method comprising:

providing a first hub portion having a first outer surface and a plurality of propeller blades extending radially therefrom, wherein the first outer surface tapers inwardly from has a first keyed end proximate the plurality of propeller blades;

providing a second hub portion having a second outer surface, wherein the second outer surface tapers outwardly from a second keyed end; and joining the first keyed end and the second keyed end to each other.

19. The method of claim 18, wherein the first hub portion and the second hub portion are fabricated using a die casting process.

* * * * *